US005831248A

United States Patent [19]

Hojyo et al.

[11] Patent Number: 5,831,248

[45] Date of Patent: Nov. 3, 1998

[54] HEAT-CONTROLLING DEVICE

[75] Inventors: Yoshiyuki Hojyo, Sakurai; Tohru Okuda; Shigeaki Kakiwaki, both of Nara, all of Japan

[73] Assignee: Sharp Kabushiki Kaisha, Osaka, Japan

[21] Appl. No.: 859,576

[22] Filed: May 21, 1997

[30] Foreign Application Priority Data

May 23, 1996 [JP] Japan ..... 8-128847

[51] Int. Cl.[6] ..... F27B 9/06; F27D 11/00

[52] U.S. Cl. ..... 219/388; 392/417; 392/418; 392/411; 432/59; 34/273; 34/308

[58] Field of Search ..... 432/59, 60, 234, 432/235, 236, 246; 219/388; 392/417, 418, 411; 34/273, 275, 215, 307, 308, 266

[56] References Cited

U.S. PATENT DOCUMENTS

| | | | |
|---|---|---|---|
| 3,655,173 | 4/1972 | Costello | 219/388 |
| 3,996,032 | 12/1976 | McWilliams et al. | 432/235 |
| 4,080,158 | 3/1978 | Kondo et al. | 432/59 |
| 4,533,820 | 8/1985 | Shimizu | 392/411 |
| 4,694,143 | 9/1987 | Nishimura et al. | 219/388 |
| 4,894,517 | 1/1990 | Oguri | 392/417 |
| 4,932,864 | 6/1990 | Miyabe | 432/236 |
| 5,040,236 | 8/1991 | Costello | 392/417 |
| 5,267,853 | 12/1993 | Arai | 432/59 |
| 5,315,092 | 5/1994 | Takahashi et al. | 392/418 |

FOREIGN PATENT DOCUMENTS

| | | |
|---|---|---|
| 58-46624 | 3/1983 | Japan . |
| 529232 | 2/1993 | Japan . |

*Primary Examiner*—Teresa J. Walberg
*Assistant Examiner*—Jiping Cu

[57] ABSTRACT

A heat-controlling device is provided with a transporting carriage for supporting and transporting a semiconductor substrate and a heating device having a plurality of heaters which apply heat in the width-wise direction of the heat-receiving member that is perpendicular to the transporting direction thereof and which are individually controlled by a controller. The controller only operates a set of the heaters that are adjacent the semiconductor substrate. Among the heaters being operated, those heaters, which are located at at least the leading end and the rear end in the transporting direction, have their outputs successively varied in accordance with the movement of the semiconductor substrate. Thus, it becomes possible to easily narrow the temperature distribution of the semiconductor substrate merely by controlling the output of the heaters.

20 Claims, 15 Drawing Sheets

HEAT-CONTROLLING DEVICE

FIELD OF THE INVENTION

The present invention relates to a heat-controlling device which, upon transporting a heat-receiving member, controls the heat application to the heat-receiving member so that the distribution of its surface temperature becomes uniform, and more particularly concerns a heat-controlling device which is suitable for a process wherein semiconductor devices are manufactured while the film formation is carried out with a substrate having the semiconductor elements formed thereon being transported.

BACKGROUND OF THE INVENTION

In a process in which a thin film is stacked on a substrate (hereinafter, referred to as a semiconductor wafer) that is used for manufacturing a semiconductor element and that forms, for example, a substrate of a semiconductor device, the film quality of the thin film is improved by maintaining a predetermined uniform temperature on the entire surface of the semiconductor wafer for each semiconductor wafer that is successively transported.

One example of a film-forming process of the semiconductor device is a method wherein a heating chamber and a film-forming chamber are individually provided and wherein after having preliminarily heated a semiconductor wafer in the heating chamber, the film formation is carried out in the film-forming chamber. In this case, however, an unwanted temperature distribution appears on the surface of the semiconductor wafer particularly due to the transportation from the heating chamber to the film-forming chamber, resulting in ununiform surface temperatures when a plurality of semiconductor wafers that are being transported are compared with each other. This tends to cause ununiformity in the film quality of the finished thin films.

For this reason, development efforts have been conventionally made to provide a heat-controlling device which can maintain a uniform surface temperature for any of the semiconductor wafers that are successively transported, or a heat-controlling device which can carry out a uniform film-forming process even in the event of an unwanted temperature distribution on the surface thereof.

Referring to specific examples, an explanation will be given below of the conventional heat-controlling devices:

For example, Japanese Laid-Open Patent Publication No. 29232/1993 (Tokukaihei 5-29232) has disclosed a normal-pressure vapor-phase epitaxy device which is provided with a pre-heater 52 for preliminarily applying heat to a semiconductor wafer 51 and a main heater 54 for applying heat to the semiconductor wafer 51 inside a reaction furnace 53 at which a film-forming process is carried out, both of which are positioned side by side, as shown in FIG. 14. The semiconductor wafer 51, which is placed on a transporting plate 55 that is individually provided and which is transported thereby, is successively heated by the pre-heater 52 and the main heater 54.

The surface temperature of the semiconductor wafer 51 being transported is measured by infrared temperature-measuring devices 56 that are placed at, at least, several positions inside the reaction furnace 53. The heating temperatures of the pre-heater 52 and the main heater 54 are controlled based upon the measured surface temperature of the semiconductor wafer 51. Thus, the heat application is controlled so as to keep the surface temperature of the semiconductor wafer 51 constant; this makes it possible to maintain the quality of the vapor-phase epitaxy film uniform.

For another example, as illustrated in FIG. 15, Japanese Laid-Open Patent Publication No. 46624/1983 (Tokukaisho 58-46624) has disclosed a heating device wherein a plurality of tube-shaped heating lamps 62 are lined up above a transport path through which a film-forming process is carried out on a monocrystal silicon substrate 61. These tube-shaped heating lamps 62 are arranged so that their tube axes are aligned in the direction orthogonal to the transporting direction, and placed inside a plane that is parallel to the surface of the transport path. Further, as shown in FIG. 15, the tube-shaped heating lamps 62*a*, related to the leading end, rear end and middle portion of the monocrystal silicon substrate 61 in the transporting direction, are allowed to carry out over-input lighting with an approximately 20% increase of the rating; thus, in the case when the monocrystal silicon substrate 61 is not moved, the surface temperature is maintained to have a corrugated-plate-shaped distribution within the range of 1100° C. to 1480° C.

In this heating device, the tube-shaped heating lamps 62 are lit so as to provide the above-mentioned temperature distribution, and the monocrystal silicon substrate 61 is moved relatively against the tube-shaped heating lamps 62 in the direction of the corrugation at a velocity of not less than 0.1 cm/s. Thus, the monocrystal silicon substrate 61 is partially subjected to the film-forming process little by little as its portions successively arrive directly under the tube-shaped heating lamps 62*a* that are in the over-input lighting state, and consequently, the entire region of the silicon layer of the monocrystal silicon substrate 61 is subjected to epitaxial growth.

However, in the device disclosed in the above-mentioned Japanese Laid-Open Patent Publication No. 29232/1993 (Tokukaihei 5-29232), the transporting plate 55, which is the substrate transporting means, is directly heated by the heating means; the resulting problem is that the transporting plate 55 is deformed by heat. Consequently, since the transporting plate 55 is heated and subjected to a temperature rise, the transporting plate 55 itself, in addition to the film-forming region of the semiconductor wafer 51, tends to be subjected to the film-formation. As a result, the film, stacked on the transporting plate 55, finally comes off as foreign materials (particles).

The generation of the particles causes the particles to mingle into, for example, the area where the thin film is supposed to be uniformly formed, resulting in degradation in the electrical characteristics and mechanical strength of the film formed on the semiconductor wafer 51, and consequently failing to obtain desired characteristics. Further, the particles adhere to the driving system of the device, causing malfunctions, and the particle contamination causes a reduction in the degree of cleanliness in the case of operations in a clean room.

Moreover, even if the transportation of the semiconductor wafer 51 is discontinuously carried out, the pre-heater 52 and the main heater 54, which are heating means, are operated continuously in order to keep the temperature of semiconductor wafer 51 constant in the reaction furnace 53; this causes another problem of wasteful power consumption.

Furthermore, in the case of a large-size semiconductor wafer 51, heat radiation from the peripheral portion of the semiconductor wafer 51 tends to increase, causing a large temperature distribution in the surface of the semiconductor wafer 51; this results in a problem of variations in the characteristics of the finished film, and subsequent degradation in the electrical characteristics of the film.

In the method disclosed in the above-mentioned Japanese Laid-Open Patent Publication No. 46624/1983 (Tokukaisho 58-46624), the monocrystal silicon substrate 61 is successively heated by the tube-shaped heating lamps 62 having varied heating temperatures, while it is shifted through the film-forming path; therefore, it is not possible to transport the monocrystal silicon substrate 61 with its surface temperature uniformly maintained because the surface temperature of the monocrystal silicon substrate 61 successively changes in accordance with the shift. Consequently, this device fails to meet the demand for stably forming a uniform film on a substrate while keeping the substrate temperature constant.

Further, since the inside of the film-forming path is heated, the transporting means for transporting the monocrystal silicon substrate 61 is also heated directly, resulting in film formation onto the transporting means itself and the subsequent generation of particles that raises various problems, in the same manner as the above-mentioned Japanese Laid-Open Patent Publication No. 29232/1993 (Tokukaihei 5-29232).

SUMMARY OF THE INVENTION

It is an objective of the present invention to provide a heat-controlling device that is used in a film-forming process wherein a substrate used for semiconductor formation is transported while being heated, and that controls a heating device so as to uniformly maintain the temperature of the substrate at a predetermined temperature and so as not to heat a transporting device for transporting the substrate in such a manner that: the film is uniformly formed on the substrate, the generation of particles due to a heated transporting device is prevented, power consumption resulting from the application of heat to the semiconductor substrate is reduced, and the outputting operation of the heating device is easily handled.

In order to achieve the above-mentioned objective, the heat-controlling device of the present invention is provided with a transporting device for supporting and transporting a heat-receiving member and a plurality of heating devices which apply heat in the width-wise direction of the heat-receiving member that is perpendicular to the transporting direction thereof and which are individually controlled to output. Here, the respective heating devices are placed along the transporting direction of the heat-receiving member, and have their heating range set at a length that does not exceed the length of the heat-receiving member in the transporting direction; only the heating devices that are included in the heating range are operated; and among the heating devices that are being operated, specific-position heating devices, which are located at of least the leading end and the rear end in the transporting direction, have their outputs successively varied in accordance with the movement of the heat-receiving member.

With the above-mentioned arrangement, since the heating range of the heating devices is limited to less than the length of the heat-receiving member in the transporting direction, portions of the transporting device that require no heat application, especially those portions located in the vicinity of both ends in the transporting direction, are not subjected to the heat application. Thus, thermal deformation of the transporting device and the generation of particles due to the film formation onto the transporting device itself can be prevented.

Further, among the heating devices that are being operated within the heating range, the outputs of the specific-position heating devices that heat the vicinity of the leading end and the rear end of the heat-receiving member in the transporting direction are successively varied in accordance with the movement of the heat-receiving member; thus, the temperature in the vicinity of the leading end and the rear end of the heat-receiving member in the transporting direction that are susceptible to an unwanted temperature distribution is controlled to become the same as the temperature in the other part of the heating range. Consequently, the heat-receiving member is transported with its in-plane temperature kept virtually constant.

Moreover, in order to achieve the above-mentioned objective, the heat-controlling device of the present invention is provided with a transporting device for supporting and transporting a heat-receiving member and a heating device that is placed along the transporting direction of the heat-receiving member and that heats the heat-receiving member, and a heat-insulating member that shifts integrally with the transporting device is placed in the vicinity of the peripheral edge of the heat-receiving member.

With the above-mentioned arrangement, since the heat-insulating member is placed on the peripheral edge of the heat-receiving member that is greatly susceptible to heat loss caused by the transportation, it is possible to easily make the temperature of the heat-receiving member uniform. Further, this arrangement eliminates the need for increasing the output of the heating device so as to compensate for heat loss on the peripheral edge of the heat-receiving member, thereby making it possible to reduce power consumption.

For a fuller understanding of the nature and advantages of the invention, reference should be made to the ensuing detailed description taken in conjunction with the accompanying drawings.

DESCRIPTION OF THE EMBODIMENT

The following description will discuss one embodiment of the present invention. In the present embodiment, for convenience of explanation, an explanation will be given of a case in which a substrate (hereinafter, referred to as a semiconductor substrate) used for forming a semiconductor element is applied as a heat-receiving member.

Figure 1:
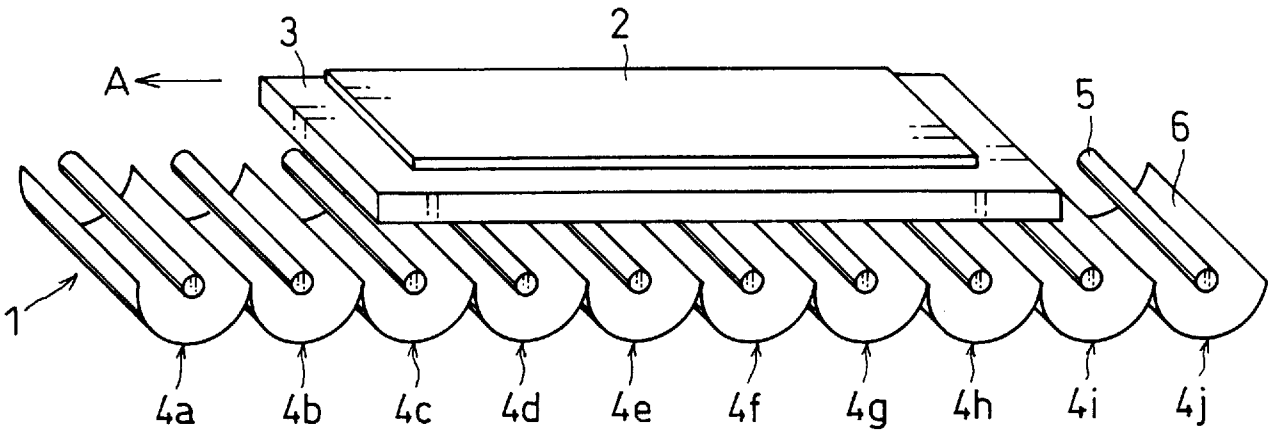
FIG. 1 is a schematic perspective view of a heat-controlling device in accordance with one embodiment of the present invention.

As illustrated in FIG. 1, the heat-controlling device of the present invention is provided with a heating device 1 and a transporting carriage 3 that functions as a transporting means and that supports a semiconductor substrate 2 that is a heat-receiving member, and carries it in a direction indicated by arrow A. The semiconductor substrate 2, supported by the transporting carriage 3, is heated by the heating device 1 while being transported in the direction of arrow A. Here, the transporting carriage 3 is driven by a driving means, not shown, and allowed to move on the heating device 1 at a predetermined speed in the direction of arrow A.

The heating device 1 has a plurality of heaters 4 that function as a heating means for applying heat in the width-wise direction of the semiconductor substrate 2 that is perpendicular to the transporting direction thereof. These heaters 4 are respectively controlled for their output in an independent manner by a controller 20. Here, in the present embodiment and the succeeding embodiment, in order to identify respective positions of the heaters 4, symbols such as a, b, c . . . etc. are added to reference numerals of the heaters, as indicated by 4*a*, 4*b*, . . . , 4*j*. However, the performance of the respective heaters 4 is the same, and in the case when positions of the heaters 4 are not particularly specified, an explanation will be given by simply referring to them as heaters 4 without adding symbols such as a, b, c . . . etc.

Each heater 4 is constituted by a heating lamp 5 that is placed in the width-wise direction of the semiconductor substrate 2 that is perpendicular to the transporting direction and a reflection member 6 that has a virtually semicylindrical shape and that supplies the heat of the heating lamp 5 efficiently to the semiconductor substrate 2 that serves as the heat-receiving member.

Figure 2:
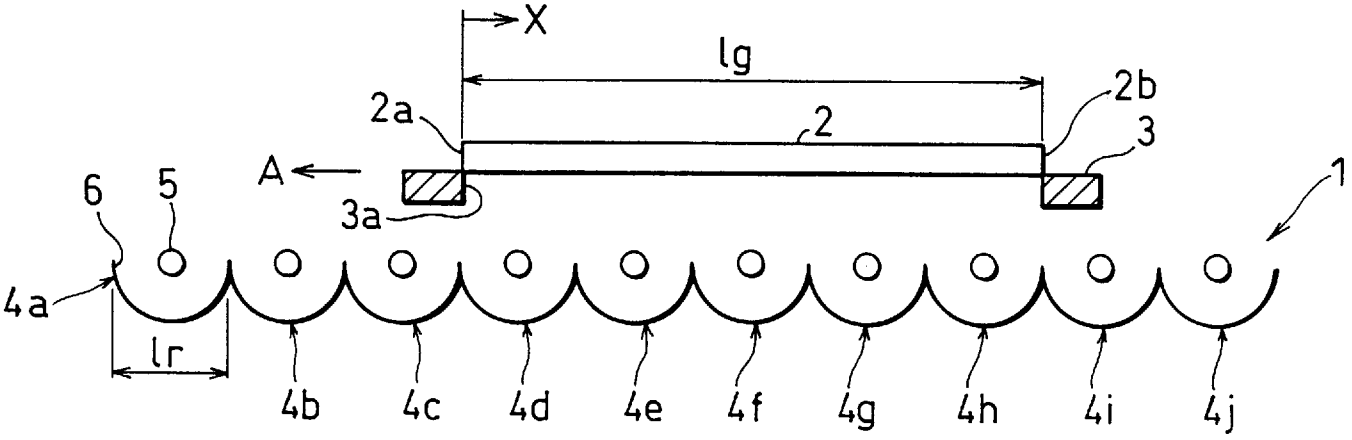
FIG. 2 is a schematic side view that shows a cross section of the heat-controlling device shown in FIG. 1.

The heating lamps 5 are respectively controlled for their outputs in an independent manner, and each of them is placed on the center axis of the reflection member 6. As illustrated in FIG. 2, the reflection members 6, each of which has a width (diameter) of lr in the transporting direction, are lined up with their respective center axes oriented perpendicular to the transporting direction, with intervals of less than the length lg of the semiconductor substrate 2. Thus, the heating lamps 5 are lined up with constant intervals, and if their outputs are the same, the semiconductor substrate 2 is uniformly heated. Therefore, by changing the outputs of the respective heating lamps 5, the quantity of heat to be applied to the semiconductor substrate 2 can be freely controlled.

The semiconductor substrate 2, which has a virtually rectangular shape with a uniform thickness, is supported by the transporting carriage 3 so that, when transported, its end face 2*a* in the transporting direction is set perpendicular to the transporting direction, that is, set virtually in parallel with the heating lamps 5 of the heaters 4 in the heating device 1. With this arrangement, the semiconductor substrate 2 is uniformly heated in the width-wise direction, that is, in the direction perpendicular to the transporting direction, as the transporting carriage 3 moves.

The transporting carriage 3 is virtually plate-shaped with a surface larger than the semiconductor substrate 2, and as illustrated in FIG. 2, an opening 3*a* is formed in its center so as to allow the semiconductor substrate 2 to face the heating device 1. The opening 3*a* is shaped into such a size that virtually the entire surface of the semiconductor substrate 2 is allowed to face the heating device 1, and the surface of the semiconductor substrate 2 that faces the heating device 1 is uniformly heated by the heating device 1. Here, with respect to the transporting carriage 3, the semiconductor substrate 2 is supported thereon by a supporting means, not shown.

In the heat-controlling device with the above-mentioned arrangement, a predetermined length that does not exceed the length (lg) of the semiconductor substrate 2 in the transporting direction is set as a heating range, and only the heaters 4 included in the heating range are operated, as illustrated in FIG. 2.

In FIG. 2, heaters 4*d*, . . . , 4*g* are operated. Further, the outputs of heaters 4*d* and 4*g* that are designated as specific-position heating means located at of least the leading end and rear end in the transporting direction among the operating heaters 4 are successively varied in accordance with the movement of the semiconductor substrate 2. Here, the specific-position heating means are successively changed, for example, from heaters 4*d* and 4*g* to heaters 4*c* and 4*f* in succession in accordance with the movement of the semiconductor substrate 2.

Figure 3:
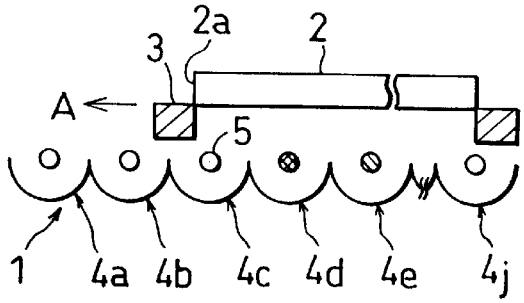
FIGS. 3(*a*) through 3(*g*) are explanatory drawings that show heating processes in a heating device of the heat-controlling device shown in FIG. 1.
Figure 3:
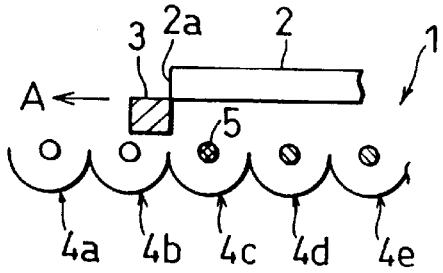
Figure 3:
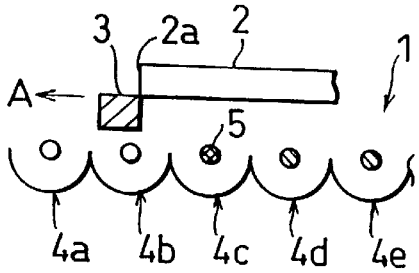
Figure 3:
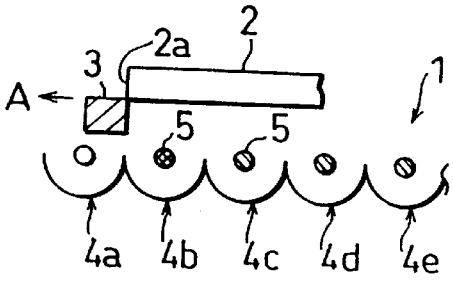
Figure 3:
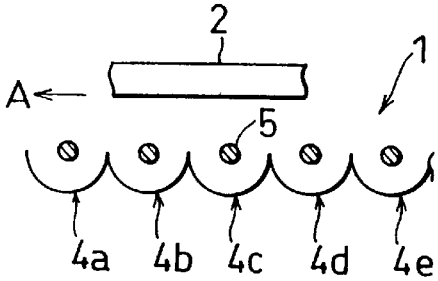
Figure 3:
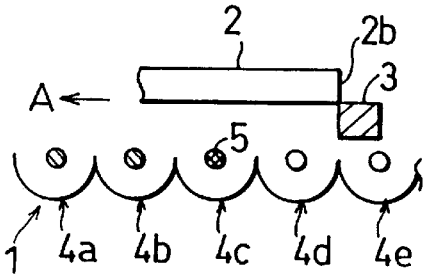
Figure 3:
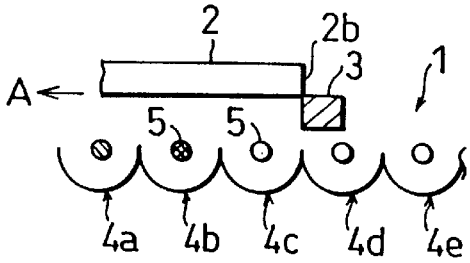
Figure 3:
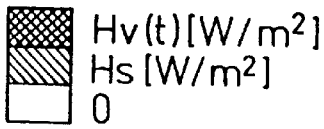
Figure 4:
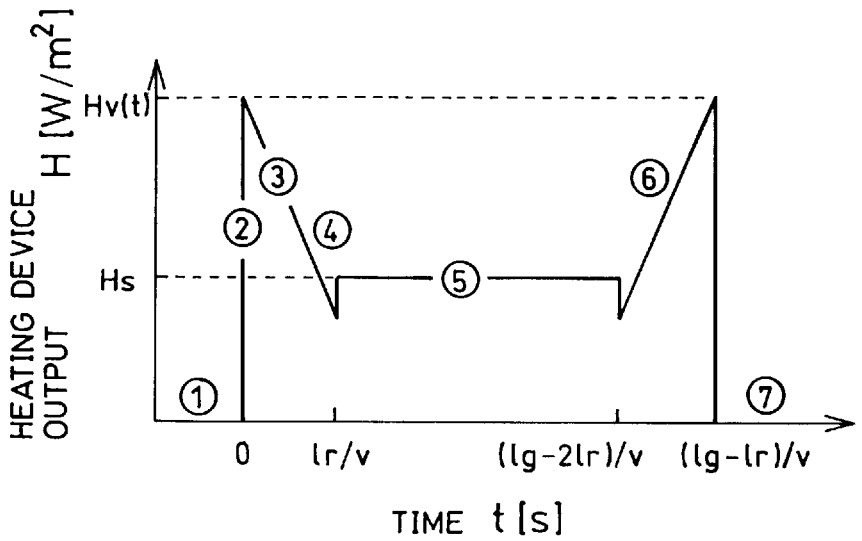
FIG. 4 is a graph that shows the relationship between the outputs of heaters and time in the heating processes shown in FIGS. 3(*a*) through 3(*g*).

Referring to FIGS. 3 and 4, the following description will discuss the output control of the heaters 4 in the heating device 1. Here, among the heaters 4, an explanation will be given of the output control of heater 4*c* that is the third heater from the leading side in the transporting direction in the drawings.

When the transporting carriage 3 proceeds in the direction of arrow A so that the leading portion of the transporting carriage 3 is located on the upper surface of heater 4*c* as illustrated in FIG. 3(*a*), heater 4*c* is not turned on. At this time, the output of heater 4*c* is held in state ① shown in FIG. 4. Here, supposing that the time (elapsed time) in which the transporting carriage 3 passes on the heating device 1 at a shifting velocity v is represented by t, and that the time at which the leading portion of the transporting carriage 3 leaves the upper surface of heater 4*c* is represented by t=0, t<0 is held and FIG. 3(*a*) shows that the transporting carriage 3 has not yet reached a reference point in this state.

If the elapsed time t is defined more specifically, the reference (t=0) is given as the time at which the leading-end face 2*a* of the semiconductor substrate 2 comes to coincide with the side-end surface of heater 4*c* in the transporting direction (hereinafter, referred to simply as a leading face) as the semiconductor substrate 2 is transported.

When t=0, heater 4*c* is activated and the heating lamp 5 is turned on, as illustrated in FIG. 3(*b*). At this time, the output of heater 4*c* (the output H [W/m$^2$] of the heating device 1) is temporarily set at an output Hv [W/m$^2$] (given as state ② in FIG. 4) that is larger than the output Hs [W/m$^2$] required to raise the temperature of the substrate per unit area to a constant temperature. Then, as illustrated in FIG. 3 (*c*), in order to compensate for quantity of heat of the portion on the leading-end side of the semiconductor substrate 2 to which heater 4*c* fails to apply heat, the output of heater 4*c* is controlled so as to have a slope ③ shown in FIG. 4, while the leading-end face 2*a* of the semiconductor substrate 2 is passing over heater 4*b* that is one heater ahead of heater 4*c* ($0<t<lr/v$ ).

Further, as illustrated in FIG. 3(*d*), when $t=lr/v$ is satisfied, that is, when the leading-end face 2*a* of the semiconductor substrate 2 has reached the leading face of heater 4*b*, the output of heater 4*c* is controlled to vary from state ④ to state ⑤ so as to reach Hs as shown in FIG. 4. Thereafter, as illustrated in FIG. 3(*e*), the output of heater 4*c* is held at Hs until the rear-end face 2*b* of the semiconductor substrate 2 (see FIG. 3(*f*)) has reached the rear-end portion of heater 4*d* that is one heater behind heater 4*c*, that is, during the period indicated by $lr/v<t<(lg-2lr)/v$.

Thereafter, when the rear-end face 2*b* of the semiconductor substrate 2 has reached the leading face of heater 4*d* that is one heater behind heater 4*c*, the output of heater 4*c* is again varied to Hv. In other words, as illustrated in FIG. 3(*f*), the output of heater 4*c* is controlled as shown in state ⑥ of FIG. 4 until the rear-end face 2*b* of the semiconductor substrate 2 has reached the leading face of heater 4*d*, that is, during the period indicated by $(lg-2lr)/v\leqq t<(lg-lr)/v$.

As illustrated in FIG. 3(*g*), when the rear-end face 2*b* of the semiconductor substrate 2 has reached the rear face of heater 4*d*, the output of heater 4*c* is again set at 0 as shown by state ⑦ in FIG. 4.

In the above-mentioned explanation, one of the heaters 4*c* was exemplified; however, during the transportation of the semiconductor substrate 2, the same output control as shown in FIG. 4 is carried out on the other heaters 4, except that the timing of each output control differs by $t=lr/v$. In other words, heater 4*d*, located one heater ahead of heater 4*c*, is subjected to the output control that precedes that of heater 4*c* by $t=lr/v$, and heater 4*b*, located one heater behind heater 4*c*, is subjected to the output control that succeeds that of heater 4*c* by $lr/v$.

When the output control of the heaters 4 is carried out as shown in FIGS. 3(*a*) through 3(*g*) as well as FIG. 4, the semiconductor substrate 2 is heated by the heating device 1 only within the heating range. Thus, it becomes possible to prevent the transporting carriage 3 from being unnecessarily heated. Therefore, it is possible to eliminate the probability that the transporting carriage 3 is heated and that the transporting carriage 3 itself is subjected to a film formation. Consequently, the generation of particles can be prevented and the ingress of the particles into the film to be formed on the semiconductor substrate 2 can be prevented, both contributing improvement of the quality of the film.

Moreover, in general, heat radiation tends to remarkably appear on the peripheral portion of the semiconductor substrate 2; however, in order to compensate for the heat loss due to the heat radiation, the output of the heater 4 is set higher upon heating the leading end and rear end corresponding to the peripheral portion of the semiconductor substrate 2 than upon heating the center portion of the semiconductor substrate 2. This makes it possible to ensure the uniform temperature of the semiconductor substrate 2.

Next, an explanation will be given more specifically of the output variation of each heater 4 in the heating device 1.

The quantity of heat Q [J] that is supplied from the heater 4 having an output H [W/m$^2$] to the semiconductor substrate 2 having an area S [m$^2$] is represented by the following equation (1):

$$Q=H\cdot S\cdot t \tag{1}$$

In the case when the semiconductor substrate 2 is kept at a constant temperature, the quantity of heat Qs [J] that is supplied to a portion of the semiconductor substrate 2 having a width of h [m] and a length of lr [m] during a period of lr/v [s] is represented by the following equation (2), based upon the above-mentioned equation (1):

$$Qs = Hs\cdot hlr\cdot\frac{lr}{v} \tag{2}$$

Here, Hs [W/m$^2$] is defined as a constant output per unit area required for keeping the semiconductor substrate 2 at a predetermined constant temperature.

In accordance with the above-mentioned equation (2), in the case when the semiconductor substrate 2 is transported at a constant velocity v [m/s], supposing that the length in the transporting direction of the semiconductor substrate 2 is x [m] when measured from the leading-end face 2*a* thereof as a reference point, the area in association with the heater 4 within the range $0\leqq x\leqq lr$ [m] is represented by $h\times(lr-vt)$ [m$^2$]; therefore, the quantity of heat dQm [J] that is supplied to the area $h\times(lr-vt)$ [m$^2$] during the time dt [s] is represented by the following equation:

$$dQm=Hv(t)\{h(lr-vt)\}dt \tag{3}$$

Here, Hv(t) [W/m$^2$] represents the output of the heater 4 at the time t [s] in the case of $0\leqq t\leqq lr/v$ [s].

In accordance with the above-mentioned equation (3), the quantity of heat Qm [J] that is supplied to the semiconductor substrate 2 within the range $0\leqq x\leqq lr$ [m] during the time in which the semiconductor substrate 2 is shifted by lr [m], that is, during the time lr/v [s], is represented by the following equation (4):

$$Qm=\int_0^{lr/v} dQm=\int_0^{lr/v} Hv(t)\{h(lr-vt)\}dt \tag{4}$$

In accordance with the above-mentioned equations (2) and (4), if Qs [J] and Qm [J] are equal, it is possible to maintain the semiconductor substrate 2 at a constant temperature. Therefore, the output of the heater 4 is varied in a manner so as to satisfy the following equation (5):

$$Hs\cdot h\frac{lr^2}{v}=\int_0^{lr/v} Hv(t)\{h(lr-vt)\}dt \tag{5}$$

Moreover, in the same manner as described above, in the case of $(lg-2lr)/v<t<(lg-lr)/v$ [s], the output of the heater 4 is varied in a manner so as to satisfy the following equation (6):

$$Hs\cdot h\cdot\frac{lr^2}{v}=\int_{(lg-2lr)/v}^{(lg-lr)/v} Hv(t)\{h(vt-lg+2lr)\}dt \tag{6}$$

One of the solutions of the output H(t) [W/m$^2$] that satisfies the above-mentioned equations (5) and (6) is given as follows:

$$Hv(t) = 0 \quad (t < 0)$$

$$= \left(2 + \frac{clr}{3v} - ct\right) Hs \qquad \left(0 \leqq t < \frac{lr}{v}\right)$$

$$= Hs \qquad \left(\frac{lr}{v} \leqq t < \frac{lg - 2lr}{v}\right)$$

$$= \left(2 + \frac{4clr}{3v} - \frac{clg}{v} + ct\right) Hs \qquad \left(\frac{lg - 2lr}{v} \leqq t < \frac{lg - lr}{v}\right)$$

$$= 0 \qquad \left(t \geqq \frac{lg - lr}{v}\right)$$

where $0 \leqq c \leqq \frac{3v}{lr}$ .

Figure 5:
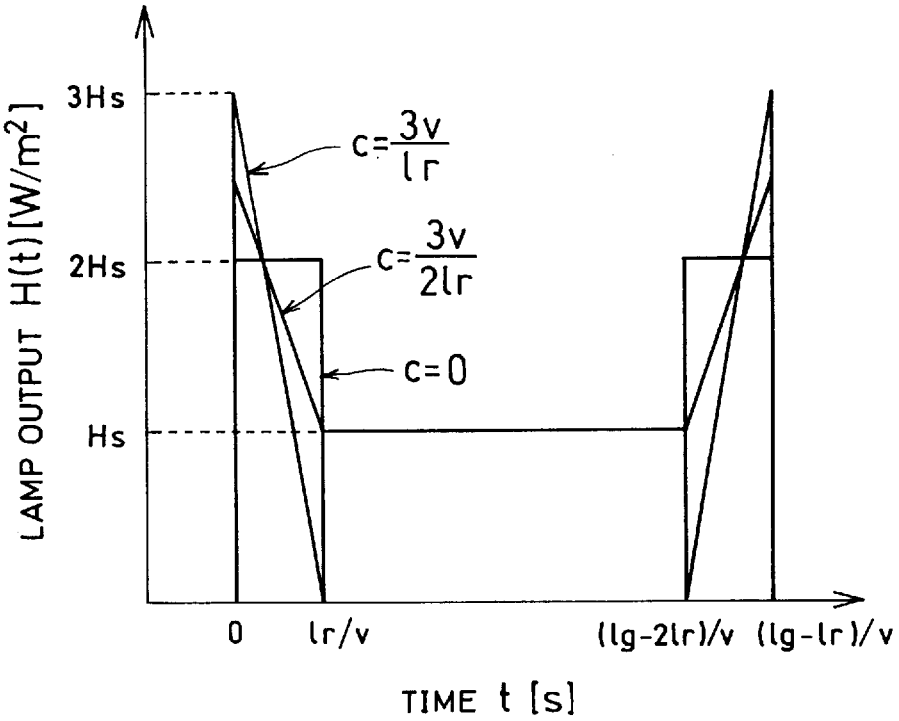
FIG. 5 is a graph that shows the output control of the heaters in the heat-controlling device of FIG. 1.

The output control of the heater 4 based on the above-mentioned solution is shown by, for example, a graph in FIG. 5. The above-mentioned solution indicates that in most cases the temperature distribution can be made smaller by increasing c. The graph of the heater output control of FIG. 5 shows that the case indicated by c=3v/2lr is more preferable than the case indicated by c=3v/lr. Here, an appropriate value of c is provided depending on heat-radiating conditions such as radiation from side faces.

Supposing that Hv(t) [W/m$^2$] is a constant in the above-mentioned equations (5) and (6), the heater output Hv(t) [W/m$^2$] has the following solution:

$$\begin{aligned} Hv(t) &= 0 \quad (t < 0) \\ &= 2Hs \quad \left(0 \leqq t < \frac{lr}{v}\right) \\ &= Hs \quad \left(\frac{lr}{v} \leqq t < \frac{lg - 2lr}{v}\right) \\ &= 2Hs \quad \left(\frac{lg - 2lr}{v} \leqq t < \frac{lg - lr}{v}\right) \\ &= 0 \quad \left(t \geqq \frac{lg - lr}{v}\right) \end{aligned}$$

The output control of the heater 4 based on the above-mentioned solution is given as a graph of c=0 in FIG. 5. In this manner, supposing that Hv(t) [W/m$^2$] is a constant, the output control of the heater 4 can be carried out very easily. However, since the quantity of heat supply becomes insufficient in the vicinity of x=0 [m] while the quantity of heat supply becomes excessive in the vicinity of x=lr [m], it is not possible to further minimize the temperature distribution of the semiconductor substrate 2.

Figure 6:
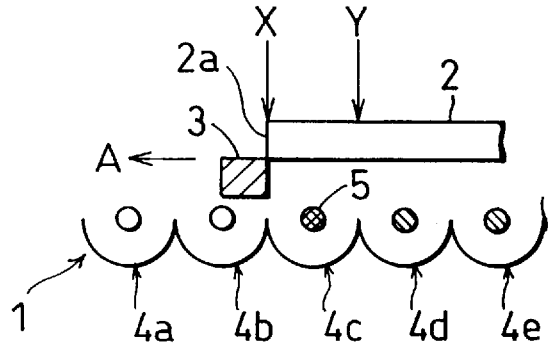
FIGS. 6(*a*) through 6(*c*) are schematic side views that explain excessive and insufficient states of the amount of heat supply to a semiconductor substrate in the heat-controlling device shown in FIG. 1.
Figure 6:
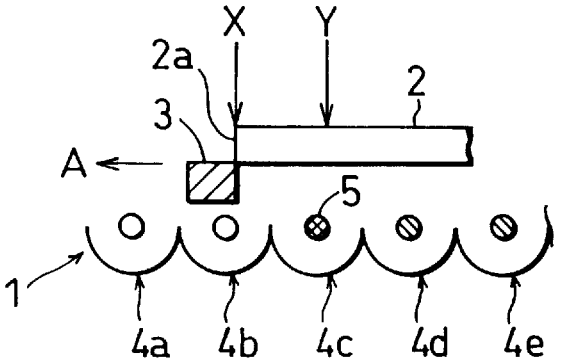
Figure 6:
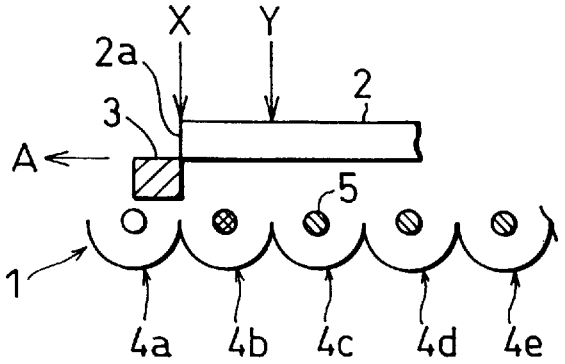
Figure 6:
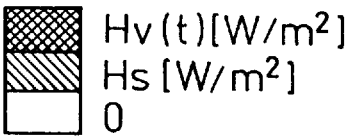
Figure 7:
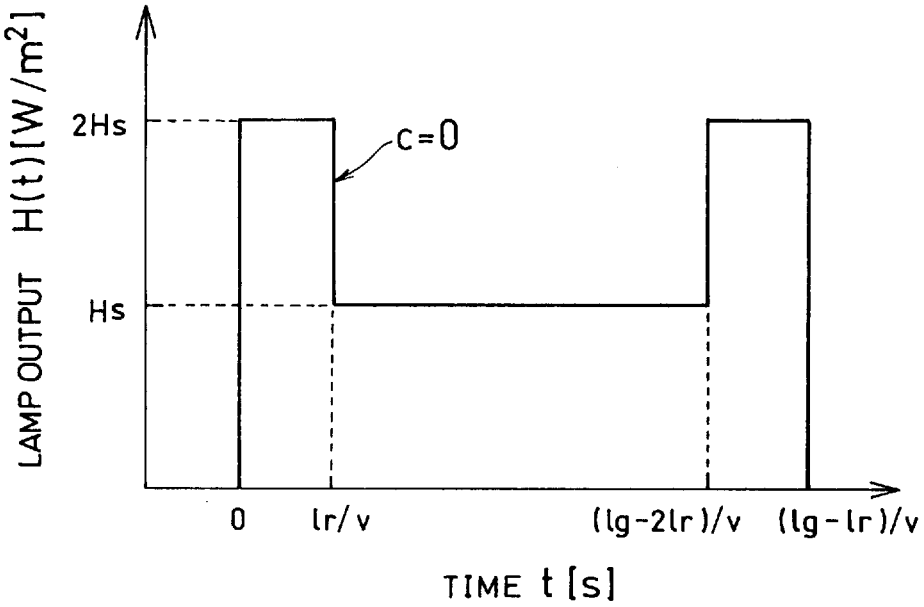
FIG. 7 is a graph that shows the output control of the heaters that is performed so as to eliminate the excessive and insufficient states of the amount of heat supply to the semiconductor substrate, shown in FIGS. 6(*a*) through 6(*c*).

In other words, as shown in FIGS. 6(*a*) through 6(*c*), when the semiconductor substrate 2 is transported while it is being heated by the heating device 1, the irradiation time of heater 4*c* becomes very short in the vicinity of position X corresponding to the proximity of the leading-end of the semiconductor substrate 2. In contrast, in the vicinity of position Y corresponding to the center portion of the semiconductor substrate 2, the irradiation of the heater 4 is always carried out. For this reason, when the output control of the heater 4 as shown in FIG. 7 is carried out, the quantity of heat supply becomes insufficient in the vicinity of position X corresponding to the proximity of the leading-end of the semiconductor substrate 2, while in the vicinity of position Y corresponding to the proximity of the center portion of the semiconductor substrate 2, the quantity of heat supply becomes excessive so that twice as much Hs is always supplied.

Figure 8:
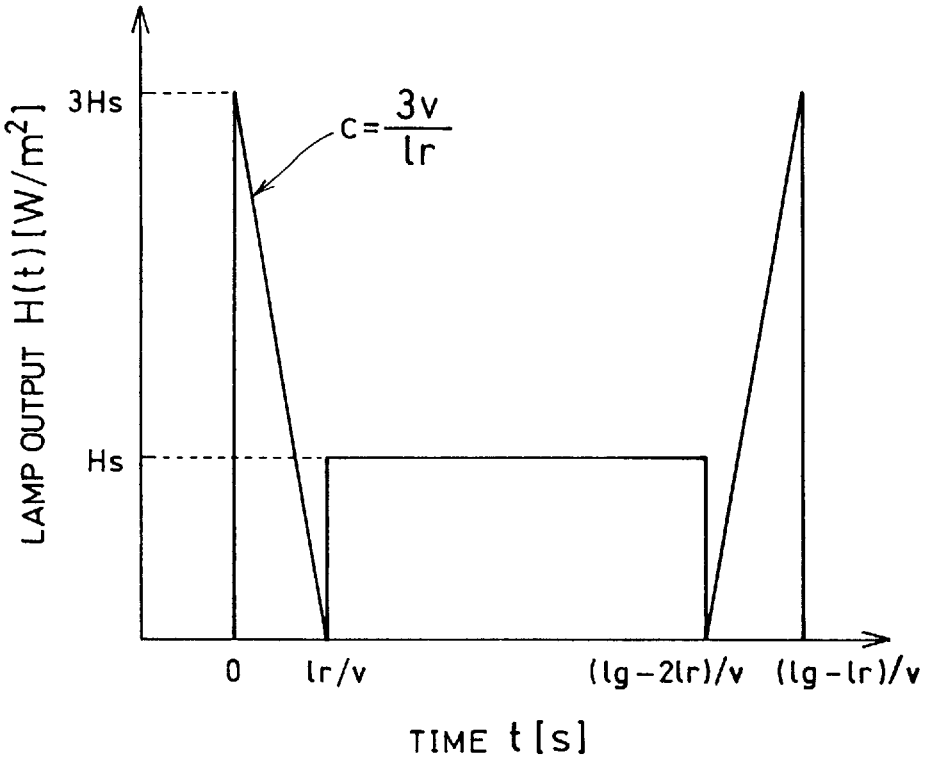
FIG. 8 is a graph that shows the output control of the heaters that is performed so as to eliminate the excessive and insufficient states of the amount of heat supply to the semiconductor substrate, shown in FIGS. 6(*a*) through 6(*c*).

Therefore, the output control of the heater 4 is carried out in a manner as indicated by graphs of c=3v/2lr and c=3v/lr in the above-mentioned equations (5) and (6); thus, it becomes possible to eliminate the insufficient and excessive quantity of heat supply to the semiconductor substrate 2. In particular, when the output of the heater 4 is controlled as indicated by c=3v/lr, an output, which is three times as much as the output Hs of the heater 4 applied to the vicinity of position Y, is temporarily applied to the heater 4 in the vicinity of position X corresponding to the proximity of the leading-end of the semiconductor substrate 2, as shown in FIG. 8. Thus, it becomes possible to compensate for the insufficient quantity of heat supply in the vicinity of position X corresponding to the proximity of the leading-end of the semiconductor substrate 2. In this manner, by increasing the value of c, the insufficient heat supply can be eliminated, and it becomes possible to narrow the temperature distribution of the semiconductor substrate 2.

Moreover, in the case when, even after the switch-off of the heater 4, the substrate is heated by residual heat of the heater 4, it is necessary to determine the output control of the heater 4, that is, the value of c, by preliminarily taking into account the corresponding quantity of heat. In particular, for large-size substrates that have greater quantities of heat radiation from the side faces, it becomes possible to further stabilize the temperature of the semiconductor substrate 2 by carrying out the output control of the heater 4 by taking into account the quantity of heat radiation.

Figure 9:
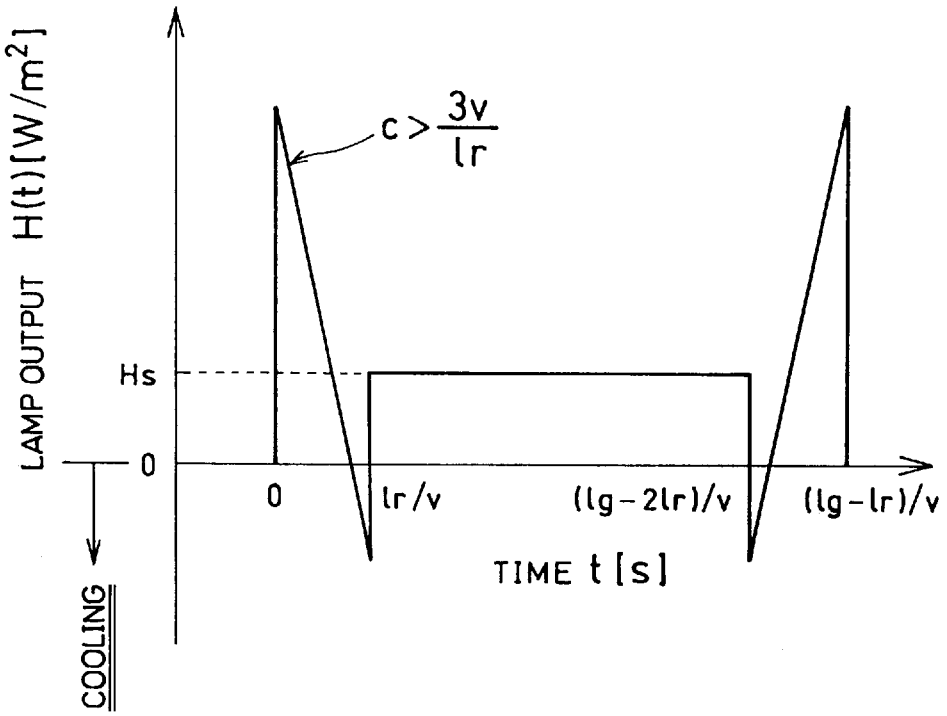
FIG. 9 is a graph that shows the output control of the heaters that is performed so as to eliminate the excessive and insufficient states of the amount of heat supply to the semiconductor substrate, shown in FIGS. 6(*a*) through 6(*c*).

However, when the stability of the temperature of the semiconductor substrate 2 is aimed by increasing the value of c, the following problems tend to arise. In FIG. 8, in order to reduce the quantity of heat supply, the output of the heater 4 is instantaneously made zero immediately before the time t=lr/v at which the output of the heater 4 reaches Hs. Even after the output of the heater 4 becomes zero in this manner, the semiconductor substrate 2 is still heated by the quantity of heat of the heater 4 itself; therefore, for example, in the case when the output of the heater 4 is controlled as indicated by c>3v/lr, the temperature of the semiconductor substrate 2 may become higher than the other portions at the time of t=lr/v. Accordingly, in the case of the output control of the heater 4 as indicated by c>3v/lr, it is necessary to cool off the semiconductor substrate 2 before the time t=lr/v, as shown in FIG. 9. This necessitates the installation of a cooling means in the heating device 1 in addition to the heaters 4 that serve as heating means, thereby making the device unrealistic from the standpoint of designing. Further, the value of c is limited from the standpoint of performances and other aspects of the heating lamps 5. Therefore, the value of c has to be determined by taking into account materials of the semiconductor substrate 2, performances of the heating lamps 5, etc.

Figure 10:
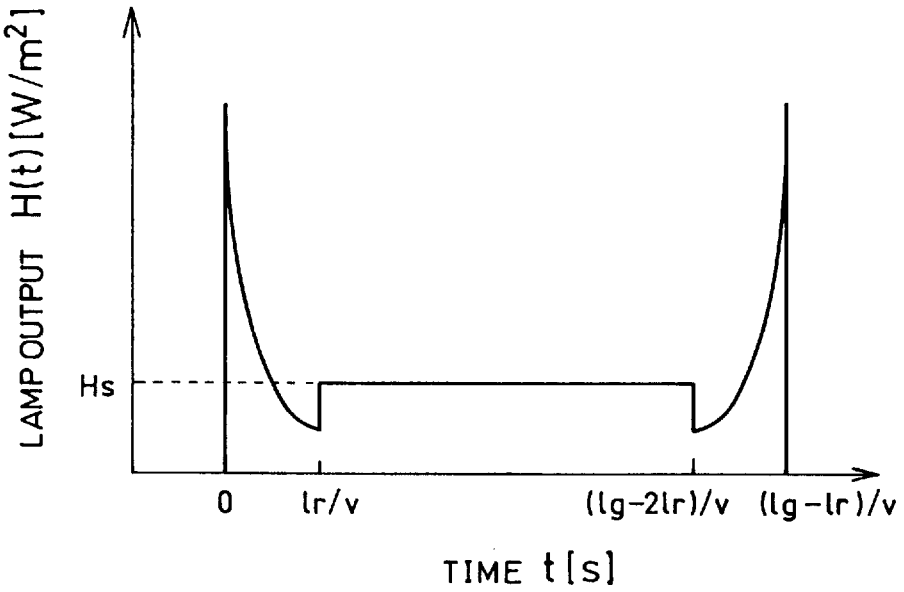
FIG. 10 is a graph that shows the output control of the heaters that is performed so as to eliminate the excessive and insufficient states of the amount of heat supply to the semiconductor substrate, shown in FIGS. 6(*a*) through 6(*c*).

Moreover, supposing that the above-mentioned Hv(t) [W/m$^2$] is defined as a high-order function of t[s] that satisfies the above-mentioned equations (5) and (6), the output control of the heater, as shown in a graph of FIG. 10, is obtained, and this arrangement further improves the degree of uniformity in the in-plane temperature of the substrate.

Here, the output control of the respective heaters 4 is carried out by a microcomputer that serves as a control means installed in the present heat-controlling device. In this case, the microcomputer preliminarily stores the aforementioned equations (1) through (6) and the solutions acquired from the equations (5) and (6), and executes programs that are constructed to provide desired outputs based on the equations, thereby controlling voltages released from the microcomputer on a time basis so that the output control of the heater 4 is carried out.

The following description will discuss a specific example of the heat-controlling device.

Here, an explanation will be given of a heat-controlling device wherein: the length lg of the semiconductor substrate 2 in the transporting direction is 100 [mm], the interval lr between the heaters 4 is 20 [mm], and the transporting velocity v is 1 [mm/s]. When the upper surface of a heater 4 faces the transporting carriage 3, the output of the corresponding heater 4 is held in an off-state. When the leading-end face 2*a* of the semiconductor substrate 2 has come to coincide with the leading face of the heater 4, that is, when t=0 [s] has been reached, the corresponding heater 4 is turned on. After the heater 4 has been turned on, the output of the heater 4 is temporarily varied in order to compensate for the quantity of heat of the semiconductor substrate 2 (in the vicinity of X) that has not been heated by the heater 4. Further, when the leading-end face 2*a* of the semiconductor substrate 2 has come to coincide with the leading face of the heater 4 that is located one heater ahead, that is, when t=20 (=lr/v) [s] has been reached, the output of the heater 4 is made constant. Then, the output of the heater 4 is held constant for a while, and when the rear-end face 2*b* of the semiconductor substrate 2 has come to coincide with the rear face of the heater 4 that is located one heater behind, that is, when t=60 (=(lg=2lr)/v) [s] has been reached, the output of the heater 4 is again varied. When the rear-end face 2*b* of the semiconductor substrate 2 has come to coincide with the rear face of the heater 4, that is, when t=80 (=(lg−lr)/v) [s] has been reached, the heater 4 is turned off. The above-mentioned output control of the heater 4 is respectively carried out on each of the heaters 4.

Here, in the above-mentioned example, the length lg of the semiconductor substrate in the transporting direction is set at 100 [mm], the interval lr between the heaters is set at 20 [mm], and the transporting velocity v is set at 1 [mm/s]; however, the present invention is not specifically limited by these numerical values, and in the case of varied numerical values, the output control of the heaters is properly carried out by a microcomputer in accordance with the varied numerical values so as to obtain a uniform temperature distribution of the substrate to be heated.

With the above-mentioned arrangement, by limiting the heating range of the heater 4 with respect to the length in the transporting direction of the semiconductor substrate 2, it becomes possible to avoid application of heat to portions of the transporting carriage 3 that require no application of heat, in particular, to both of the ends in the transporting direction. Consequently, thermal deformation of the transporting carriage 3 and the generation of particles due to the film formation onto the transporting carriage 3 itself can be prevented.

Moreover, among the heaters 4 that are operating within the heating range, those heaters 4, which serve as specific-position heating devices and which heat the vicinity of the leading-end and rear-end of the semiconductor substrate 2 in the transporting direction, have their outputs successively varied in accordance with the movement of the semiconductor substrate 2; thus, the temperature in the vicinity of the leading end and the rear end of the semiconductor substrate 2 in the transporting direction that are susceptible to an unwanted temperature distribution is controlled to become the same as the temperature in the other part of the heating range. Consequently, the semiconductor substrate 2 is transported with its in-plane temperature kept virtually constant.

Furthermore, since the substrate is transported with its in-plane having a virtually uniform temperature distribution, it is possible to stably form a thin film that is adopted as a semiconductor element.

Therefore, when the present heat-controlling device is applied to a film-forming device using, for example, a monocrystal silicon substrate as the semiconductor substrate, it becomes possible to preferably carry out the film formation because it provides a narrow temperature distribution in the monocrystal silicon substrate and consequently to improve the quality of the finished film because the ingress of particles, which are impurities, into the silicon is prevented.

Additionally, in the present embodiment, the semiconductor substrate 2 is directly transported; however, a heat-insulating member that shifts integrally with the semiconductor substrate 2 may be placed in the vicinity of the peripheral edge of the semiconductor substrate 2. Since this arrangement reduces heat radiation from the peripheral edge of the semiconductor substrate 2, it becomes possible to reduce electric power to be supplied to the heaters 4.

Further, in the present embodiment, the explanation was given of the output control of the heaters 4 in the case when the semiconductor substrate 2 is directly heated by the heating device 1. In the succeeding embodiment, an explanation will be given of a heat-controlling device wherein a semiconductor substrate 2 is placed on a susceptor (heat-equalizing plate) that is a plate-shaped member so that the semiconductor substrate 2 is heated through the susceptor.

The following description will discuss another embodiment of the present invention. Here, for convenience of explanation, those members that have the same functions as the members described in the above-mentioned embodiment are indicated by the same reference numerals, and the description thereof is omitted.

Figure 11:
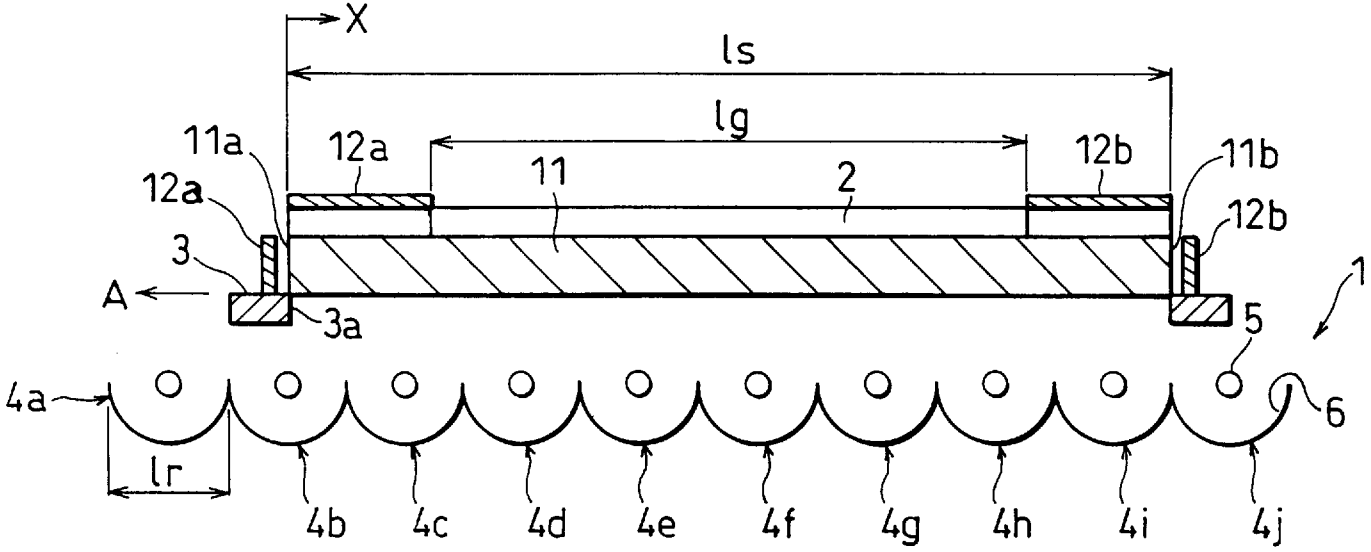
FIG. 11 is a schematic side view that shows a heat-controlling device in accordance with another embodiment of the present invention.

As illustrated in FIG. 11, in the heat-controlling device of the present embodiment, a semiconductor substrate 2 is placed in contact with a susceptor 11 that is a heat-equalizing plate placed on a transporting carriage 3, and the semiconductor substrate 2 is heated by the heating device 1 through the susceptor 11.

The susceptor 11, which has a virtually rectangular shape and which has virtually the same size as an opening 3*a* of the transporting carriage 3, is transported with its leading-end face 11*a* and its rear-end face 11*b* set virtually in parallel with heating lamps 5 of heaters 4 in the heating device 1. In this case, the susceptor 11 is held so as to expose toward the heating device 1 side from the opening 3*a* of the transporting carriage 3. Here, the susceptor 11 is supported on the transporting carriage 3 by a holding means, not shown.

Further, the susceptor 11 is designed to transmit heat from the heating device 1 to the semiconductor substrate 2 in a uniformly distributed manner, and it is necessary for the susceptor 11 to be placed on the transporting carriage 3 and carried smoothly. Therefore, its material is preferably selected from those materials which are light, that is, those materials which have smaller densities than metals, and which have great thermal conductivities as well as relatively great specific heats that give effects on thermal capacities. For example, carbon materials are used for the material.

Heat-insulating members 12 are placed between the peripheral edge of the susceptor 11 and the peripheral edge of the semiconductor substrate 2. More specifically, heat-insulating members 12*a* are placed on the leading-end face 11*a* and the upper surface on the leading-end face side of the susceptor 11, and heat-insulating members 12*b* are placed on the rear-end face 11*b* and the upper surface on the rear-end face side thereof. Moreover, although not shown in the figure, heat-insulating members are also placed on the upper surface and side faces of the susceptor 11 in its transporting direction. With this arrangement, since heat radiation from the peripheral portions of the semiconductor substrate 2 and the susceptor 11 can be prevented, it becomes possible to make the temperature distribution of the susceptor 11 uniform, and consequently to transmit heat to the semiconductor substrate 2 uniformly, thereby making it possible to improve the degree of uniformity in the in-plane temperature of the semiconductor substrate 2.

Moreover, since the quantity of heat radiation from the semiconductor substrate 2 and the susceptor 11 is reduced, it becomes possible to reduce power consumption of the heating device 1.

The operation of the heat-controlling device having the above-mentioned arrangement is carried out in virtually the same manner as the aforementioned embodiment. In other words, when the leading-end face 11*a* or the rear-end face 11*b* of the susceptor 11, instead of those of the semiconductor substrate 2 shown in FIG. 3, comes to coincide with an edge face of one of the heaters 4, the output control of the corresponding heater 4 is carried out.

The following description will discuss the operation of the heat-controlling device having the above-mentioned arrangement. With respect to symbols used here, the definitions thereof are omitted because they are the same as those described in Embodiment 1.

When the upper surface of heater 4*c* faces the transporting carriage 3, the output of the corresponding heater 4*c* is held in an off-state (t<0 [s]). When the leading-end face 11a of the susceptor 11 being transported has come to coincide with the leading face of heater 4*c*, the heating lamp 5 of the corresponding heater 4*c* is turned on (t=0 [s]). At this time, the output of heater 4*c* is controlled to such a magnitude (3Hs [W/m$^2$]) as to compensate for the quantity of heat of the leading portion of the susceptor 11 that tends to radiate heat to a great degree.

Next, during a period of time until the leading-end face 11*a* of the susceptor 11 has come to coincide with the leading face of heater 4*b* that is one heater ahead of heater 4*c* after heater 4*c* was turned on, that is, during a period of time, 0<t<lr/v [s], the output of heater 4*c* is varied from 3Hs [W/m$^2$] to Hs [W/m$^2$]. Then, when the leading-end face 11*a* of the susceptor 11 comes to coincide with the leading face of heater 4*b* that is located one heater ahead of heater 4*c* (t=lr/v[s]), the output of heater 4*c* is set at Hs [W/m$^2$].

Thereafter, during a period of time lr/v<t<(is 2lr)/v [s], the output of heater 4*c* is held at Hs [W/m$^2$] Here, ls is the length of the susceptor 11 in the transporting direction. Then, when the rear-end face 11*b* of the susceptor 11 has come to coincide with the rear face of heater 4*d* that is located one heater behind heater 4*c* (t=(ls−2lr)/v), the output of heater 4*c* is again varied. In other words, during a period of time until the rear-end face 11*b* of the susceptor 11 has come to coincide with the rear face of heater 4*c*, that is, during a period (ls−2lr)/v≦t≦(ls−lr)/v[s], the output of heater 4*c* is varied from Hs [W/m$^2$] to 3Hs [W/m$^2$]. Thereafter, when the rear-end face 11*b* of the susceptor 11 has come to coincide with the end face of heater 4*c* (t=(ls−lr)/v [s]), the output of heater 4*c* is set at zero.

The output variation of heater 4 in the heat-control device using the present susceptor 11 is obtained merely by replacing lg [m] with is [m] in equations (1) through (6) and in the solutions obtained from equations (5) and (6), described in Embodiment 1; thus, the same equations and solutions are applied to the present embodiment.

Next, an explanation will be given of a specific example of the heat-controlling device having the above-mentioned arrangement.

Here, it is supposed that the length lg of the semiconductor substrate 2 in the transporting direction is 100 [mm], the length is of the susceptor 11 is 200 [mm], the interval lr between the heaters 4 is 20 [mm], and the transporting velocity v is 1 [mm/s]. When the upper surface of a heater 4 faces the transporting carriage 3, the output of the corresponding heater 4 is held in an off-state. When the leading-end face 11*a* of the susceptor 11 has come to coincide with the leading face of the heater 4, that is, when t=0 [s] has been reached, the corresponding heater 4 is turned on. After the heater 4 has been turned on, the output of the heater 4 is temporarily varied in order to compensate for the quantity of heat of the leading portion of the susceptor 11 that has not been heated by the heater 4. Further, when the leading-end face 11*a* of the susceptor 11 has come to coincide with the leading face of the heater 4 that is located one heater ahead, that is, when t=20 (=lr/v) [s] has been reached, the output of the heater 4 is made constant. Then, the output of the heater 4 is held constant for a while, and when the rear-end face 11*b* of the susceptor 11 has come to coincide with the rear face of the heater 4 that is located one heater behind, that is, when t =160 (=(ls−2lr)/v) [s] has been reached, the output of the heater 4 is again varied. When the rear-end face 11*b* of the susceptor 11 has come to coincide with the rear face of the heater 4, that is, when t=180 (=(ls−lr)/v) [s] has been reached, the heater 4 is turned off. The above-mentioned output control of the heater 4 is respectively carried out on each of the heaters.

Here, in the above-mentioned example, the length lg of the semiconductor substrate 2 in the transporting direction is set at 100 [mm], the length is of the susceptor 11 is set at 200 [mm], the interval lr between the heaters 4 is set at 20 [mm], and the transporting velocity v is set at 1 [mm/s]; however, the present invention is not specifically limited by these numeric values, and even in the case of varied numeric values, the output control of the heaters is properly carried out by a microcomputer in accordance with the varied numeric values so as to obtain a uniform temperature distribution of the substrate to be heated.

In the heat-controlling device having the above-mentioned arrangement, the semiconductor substrate 2 is heated through the susceptor 11 that is a plate-shaped member. Since the central region of the susceptor 11 has a virtually uniform temperature, the in-plane temperature of the semiconductor substrate 2 that closely contacts the central region is allowed to become uniform. Further, since the heat-insulating members 12*a* and 12*b* are placed between the peripheral edge of the susceptor 11 and the peripheral edge of the semiconductor substrate 2, heat radiation from the susceptor 11 can be reduced. Consequently, it becomes possible to uniformly maintain the temperature of the susceptor 11 without increasing the output of the heaters 4.

As described above, with the use of the susceptor 11, the entire surface of the semiconductor substrate 2 is uniformly heated by making the semiconductor substrate 2 closely contact the central region that is easily maintained at a uniform temperature. Thus, the susceptor 11 allows the semiconductor substrate 2 to have a uniform temperature through the contact portion with its central region, without the need for compensating for heat loss at the leading end and the rear end in the transporting direction. Consequently, the heat control of the heaters 4 can be carried out in such a manner as to hold c=0, that is, as to hold Hv (t) as a constant, as shown in FIG. 7, without the need for such a control as to increase the value of c while gradually decreasing the output as shown in FIG. 8 in the aforementioned Embodiment 1.

Figure 12:
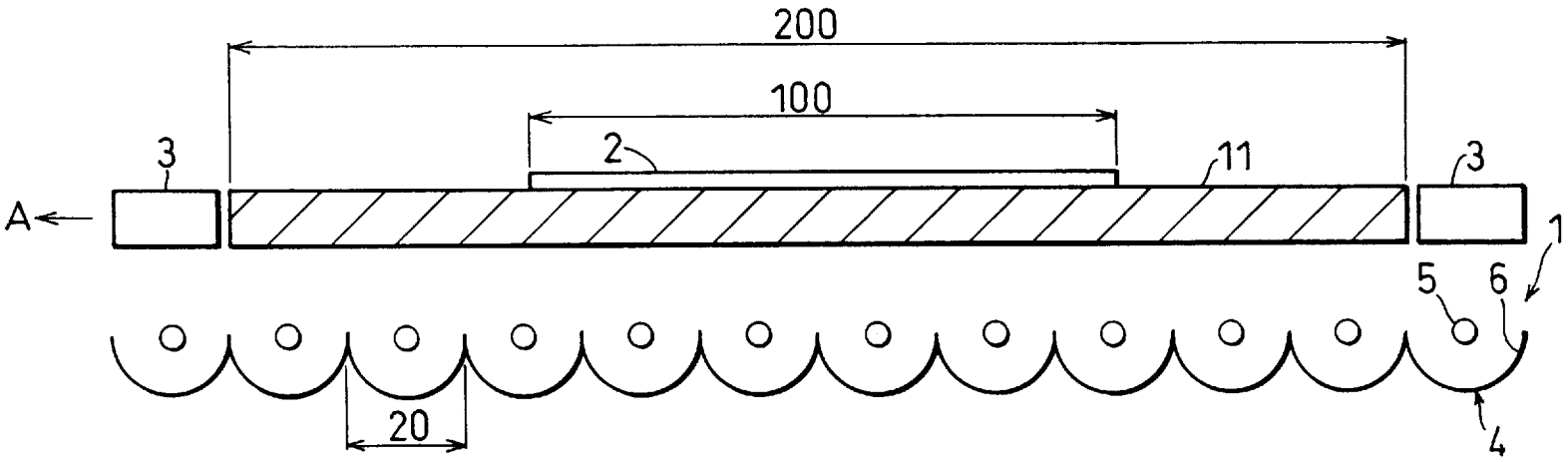
FIG. 12 is a schematic side view that shows a specific example of the heat-controlling device of FIG. 11.
Figure 13:
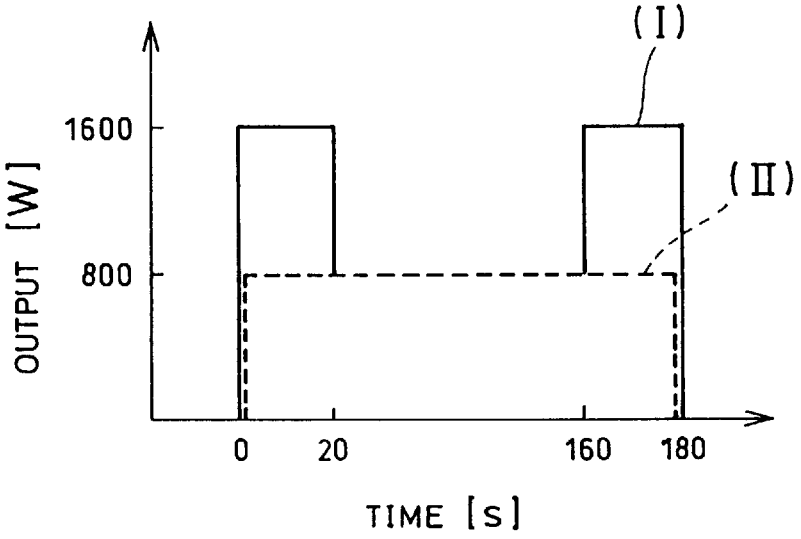
FIG. 13 is a graph that shows the output control of heaters under which a semiconductor substrate is heated by the heat-controlling device of FIG. 11.
Figure 14:
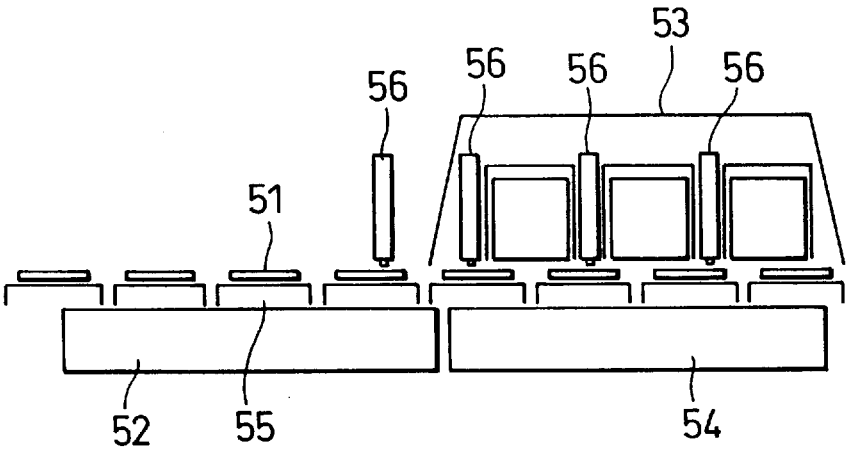
FIG. 14 PRIOR ART
FIG. 14 is a schematic side view that shows a conventional heat-controlling device.
Figure 15:
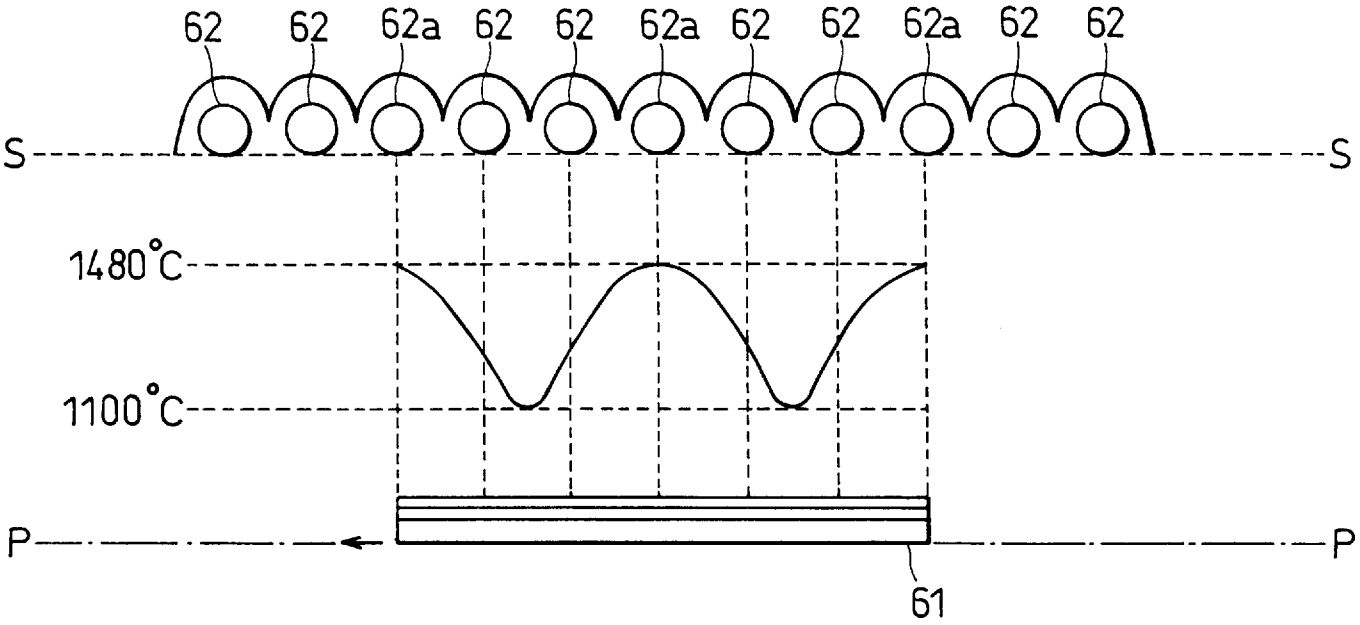
FIG. 15 PRIOR ART
FIG. 15 is a schematic side view that shows a conventional heat-controlling device.

For example, as illustrated in FIG. 13, in accordance with the respective equations described in the aforementioned Embodiment 1, the temperature distribution of the semiconductor substrate 2 was found in respective cases when (I) the output control of the heaters 4 was carried out with c=0 being held and when (II) the output control of the heaters 4 was not particularly carried out with simple on-off controls being carried out, and the results are shown as follows: With respect to the temperature distribution of the semiconductor substrate 2 that was found under various output conditions, the semiconductor substrate 2 having a dimension as shown in FIG. 12 was placed on the susceptor 11 and transported, the initial temperature of the semiconductor substrate 2 was set at 500° C. (the degree of vacuum 1 Torr in a nitrogen-gas atmosphere), and the temperature distribution of the semiconductor substrate 2 was measured 600 seconds after the start of transportation in the proceeding direction.

In the case of (I), the temperature distribution of the semiconductor substrate 2 was 500° C. +2° C.

In the case of (II), the temperature distribution of the semiconductor substrate 2 was 500° C. +15° C.

As a result, it was found that the temperature of semiconductor substrate 2 was sufficiently maintained in a uniform manner even in the case of c=0 in the aforementioned equations (5) and (6).

As described above, in the present embodiment, the heat-receiving surface of the semiconductor substrate 2 is allowed to contact the central region having a narrow temperature distribution of the susceptor 11 that is larger than the heat-receiving surface of the semiconductor substrate 2 so that the semiconductor substrate 2 can be heated through the susceptor 11. Thus, with respect to the output control of the heaters 4 in the heating device 1 that is applied to the susceptor 11, it is not necessary to carry out such a control as to hold c=3 v/lr as shown in FIG. 8 in the aforementioned Embodiment 1; it is only necessary to carry out the output control on the susceptor 11 in such a manner as to hold c=0 as shown in FIG. 7, in order to reduce the temperature distribution of the semiconductor substrate 2 being heated. Therefore, since the output control of the heater 4 is simplified, it is not necessary to carry out complicated calculations for temperate control, making it possible to achieve a heat-controlling device at low costs.

In each of the above-mentioned embodiments, the output Hs of each heater 4 regarding the central region of the semiconductor substrate 2 is set as a constant. This setting makes it possible to simplify the construction of the device. However, even if the output Hs of the heaters 4 is constant, considerable temperature distribution occurs in the central region of the semiconductor substrate 2. For this reason, instead of setting the output Hs of the heaters 4 as a constant, Hs may be set as a variable which varies the temperature of the semiconductor substrate 2 based upon the results of temperature detection data that are obtained, for example, by monitoring the temperature of the semiconductor substrate 2 using a temperature-detecting means such as a thermocouple. The application of such a controlling operation makes it possible to further reduce the temperature distribution in the central region of the semiconductor substrate 2.

Moreover, in the above-mentioned embodiments, the explanations were given of a case in which the semiconductor substrate is used as the heat-receiving member; however, a glass substrate that is applied to a liquid crystal display element and other devices that have a film formed on their surface may be used as the heat-receiving member.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A heat-controlling device comprising:

transporting means for supporting and transporting a heat-receiving member in a transporting direction;

a plurality of heating means for applying heat in a width-wise direction of the heat-receiving member, the width-wise direction being perpendicular to the transporting direction, the heating means being placed along the transporting direction of the heat-receiving member; and control means for individually controlling an amount of heat generated by each of said plurality of heating means, and for setting a heating range of said heating means at a length that does not exceed a length of the heat-receiving member in the transporting direction; and for only operating the heating means that are included in the heating range; and for allowing specific-position heating means, which are located at at least the leading end and the rear end in the transporting direction among the heating means that are being operated, to successively vary their outputs in accordance with the movement of the heat-receiving member.

2. The heat-controlling device as defined in claim 1, wherein the control means further varies the outputs of the specific-position heating means so as to compensate for heat loss that is resulted from the movement of the heat-receiving member.

3. The heat-controlling device as defined in claim 1, wherein: the transporting means comprises an opening that allows the heat-receiving member to face the heating means; and the control means also successively stops the output of the heating means, which applies heat to a rear end of the opening in the transporting direction, in accordance with the movement of the heat-receiving member.

4. The heat-controlling device as defined in claim 3, wherein the heat-receiving member is placed on a heat-equalizing plate that is installed in a manner so as to cover the opening in the transporting means.

5. The heat-controlling device as defined in claim 4, wherein a heat-insulating member is placed between a peripheral edge of the heat-equalizing plate and a peripheral edge of the heat-receiving member.

6. The heat-controlling device as defined in claim 1, wherein the heat-receiving member is a substrate used for forming a semiconductor element.

7. The heat-controlling device as defined in claim 1, wherein the control means further controls the heating means in such a manner that among the plurality of the heating means that are included within the heating range, those heating means except for the specific-position heating means have their outputs maintained virtually constant.

8. The heat-controlling device as defined in claim 1, wherein said control means provides control in such a manner that an elapsed time, which is counted based on the time at which the leading-end face of the heat-receiving member being transported is coincident with a given leading face of the heating means, is defined as t[s ], an installation interval of the heating means is defined as lr[m ], a length of the heat-receiving member in the transporting direction is defined as lg [m], a transporting velocity of the heat-receiving member resulted from the transporting means is defined as v [m/s], and an output of the heating means at a given elapsed time t[s] is defined as H(t) [$W/m^2$], the output H(t) [$W/m^2$] of the heating means is varied so as to compensate for heat loss resulted from the movement of the heat-receiving member in the case of the elapsed time t[s] of $0 \leqq t \leqq lr/v$[s] and $(lg-2lr)/v \leqq t \leqq (lg-lr)/v$[s], while output H(t) [W/m$^2$] of the heating means is maintained virtually constant in the case of the elapsed time t[s] of $lr/v \leqq t \leqq (lg-2lr)/v$[s].

9. The heat-controlling device as defined in claim 8, wherein: the heat-receiving member has a rectangular shape with its leading face and rear face in parallel with the width direction of the heating means, a constant output of the heating means per unit area required for maintaining the heat-receiving member at a uniform temperature is defined as Hs [W/m$^2$], and an output of the heating means in the case of $0 \leqq t \leqq lr/v$[s] and $(lg-2lr)/v \leqq t \leqq (lg-lr)/v$ [s] is defined as Hv(t) [W/m$^2$] with the heat-receiving member being transported, the output of the heating means is given as Hv(t) [W/m$^2$] satisfying a following equation (1), in the case of the elapsed time t [s] of $0 \leqq t \leqq lr/v$[s]:

$$Hs \cdot h \cdot \frac{lr^2}{v} = \int_0^{lr/v} Hv(t)\{h(lr - vt)\}dt, \tag{1}$$

the output of the heating means is given as Hs [W/m$^2$] in the case of the elapsed time t[s] of $lr/v \leqq t \leqq (lg-2lr)/v$ [s], and the output of the heating means is given as Hv(t) [W/m$^2$] satisfying a following equation (2), in the case of the elapsed time t[s] of $(lg-2lr)/v \leqq t \leqq (lg-lr)/v$[s]:

$$Hs \cdot h \cdot \frac{lr^2}{v} = \int_{(lg-2lr)/v}^{(lg-lr)/v} Hv(t)\{h(vt - lg + 2lr)\}dt. \tag{2}$$

10. The heat-controlling device as defined in claim 1, wherein: the heat-receiving member is placed and transported on a plate-shape member that is moved integrally with the transporting means, and the heating means heats the heat-receiving member through the plate-shaped member.

11. The heat-controlling device as defined in claim 1, wherein a heat-insulating member, which is moved integrally with the transporting means, is placed in the vicinity of a peripheral edge of the heat-receiving member.

12. The heat-controlling device as defined in claim 11, wherein: a heat-receiving surface of the heat-receiving member is allowed to closely contact a central region of a plate-shaped member that is larger than the heat-receiving surface and that is moved integrally with the transporting means, and the heat-insulating member is placed between a peripheral edge of the plate-shaped member and a peripheral edge of the heat-receiving member.

13. The heat-controlling device as defined in claim 1, wherein a heat-receiving surface of the heat-receiving member is allowed to closely contact a central region of a plate-shaped member that is larger than the heat-receiving surface and that is moved integrally with the transporting means.

14. The heat-controlling device as defined in claim 1, wherein each of the heating means includes a heating lamp that is aligned in the width-wise direction perpendicular to the transporting direction of the heat-receiving member, and a reflection member for reflecting heat from the heating lamp so as to irradiate the heat-receiving member.

15. The heat-controlling device as defined in claim 14, wherein the heating lamps are placed with equal intervals.

16. A heat-controlling device comprising:

a frame for supporting a heat-receiving member and for transporting the heat-receiving member in a transporting direction;

a plurality of heating elements, each heating element for applying heat to the heat-receiving member in a width-wise direction of the heat-receiving member, the width-wise direction being perpendicular to the transporting direction, said plurality of heating elements being spaced from each other along the transporting direction; and a controller for individually controlling a level of applied heat for each of said plurality of heating elements;

wherein the heat-receiving member has a member length taken in the transporting direction;

said controller causes a set of said heating elements to apply heat at a given time;

a set length of said set of heating elements, taken in the transporting direction, is shorter than the member length of the heat-receiving member; and said set of heating elements applying heat is adjacent to the heat-receiving member and changes to follow the heat-receiving member, as the heat-receiving member is transported in the transporting direction.

17. The heat-controlling device as defined in claim 16, wherein at least the heating elements located at the ends of said set of heating elements applying heat, taken in the transporting direction, have their applied heat level varied under control of said controller, as the heating-receiving member moves in the transporting direction, and wherein said controller causes a heating element located at a forward end of said set of heating elements, taken in the transporting direction, to apply a heat level at a first level, as the heat-receiving member is initially located adjacent said heating element located at a forward end of said set, and later causes that same heating element to reduce its applied heat level to a second level which is less than said first level, as said heat-receiving member moves in the transporting direction.

18. The heat-controlling device as defined in claim 16, wherein at least the heating elements located at the ends of said set of heating elements applying heat, taken in the transporting direction, have their applied heat level varied under control of said controller, as the heating-receiving member moves in the transporting direction, and wherein said controller causes a heating element located at a rearward end of said set of heating elements, taken in the transporting direction, to apply an elevated heat level, as the heat-receiving member is near passing out of an adjacent relationship to said heating element located at a rearward end of said set, and later causes that same heating element to reduce its applied heat level to substantially zero, as said heat-receiving member moves in the transporting direction.

19. A heat-controlling device comprising:

transporting means for supporting and transporting a heat-receiving member in a transporting direction; and heating means, placed along the transporting direction of the heat-receiving member, for heating the heat-receiving member, wherein a heat-insulating member, which is moved integrally with the transporting means, is placed in the vicinity of a peripheral edge of the heat-receiving member.

20. The heat-controlling device as defined in claim 12, wherein: a heat-receiving surface of the heat-receiving member is allowed to closely contact a central region of a plate-shaped member that is larger than the heat-receiving surface and that is moved integrally with the transporting means, and the heat-insulating member is placed between a peripheral edge of the plate-shaped member and a peripheral edge of the heat-receiving member.

* * * * *